US005818470A

United States Patent [19]

Crowley

[11] Patent Number: 5,818,470

[45] Date of Patent: Oct. 6, 1998

[54] SYSTEM AND METHOD FOR DIRECTLY FEEDING PAPER TO PRINTING DEVICES

[76] Inventor: H. W. Crowley, 310 Parker St., Newton, Mass. 02159

[21] Appl. No.: 773,887

[22] PCT Filed: Jun. 5, 1991

[86] PCT No.: PCT/US91/03948

§ 371 Date: Jun. 24, 1991

§ 102(e) Date: Jun. 24, 1991

[87] PCT Pub. No.: WO91/19957

PCT Pub. Date: Dec. 26, 1991

Related U.S. Application Data

[63] Continuation-in-part of Ser. No. 536,214, Jun. 11, 1990, Pat. No. 5,130,724.

[51] Int. Cl.[6] ..... G03G 21/00

[52] U.S. Cl. ..... 346/136; 83/359; 226/180; 271/10.02; 271/10.04; 271/258.05; 271/265.02; 271/10.07; 355/309

[58] Field of Search ..... 346/1.1, 134, 136; 355/309, 310, 311; 83/359, 370; 226/180, 194; 271/10, 258, 259, 265

[56] References Cited

U.S. PATENT DOCUMENTS

| | | | |
|---|---|---|---|
| 3,639,053 | 2/1972 | Spear, Jr. . | |
| 3,709,492 | 1/1973 | Baker et al. . | |
| 3,718,394 | 2/1973 | Tysko et al. | 355/310 |
| 3,981,493 | 9/1976 | Klappenecker et al. | 271/10 |
| 4,009,957 | 3/1977 | Suzuki et al. | 156/351 |
| 4,012,139 | 3/1977 | Washio et al. . | |
| 4,318,540 | 3/1982 | Paananen et al. | 271/4 |
| 4,893,763 | 1/1990 | Wales et al. | 242/58.6 |
| 4,933,727 | 6/1990 | Mizuma et al. | 355/327 |
| 4,941,377 | 7/1990 | Ishihara et al. | 83/211 |
| 5,130,724 | 7/1992 | Crowley | 346/1.1 |

FOREIGN PATENT DOCUMENTS

| | | | |
|---|---|---|---|
| 391632 | 10/1990 | European Pat. Off. | 355/310 |
| 55-115035 | 9/1980 | Japan . | |

*Primary Examiner*—Benjamin R. Fuller
*Assistant Examiner*—John Barlow
*Attorney, Agent, or Firm*—Wolf, Greenfield & Sacks, P.C.

[57] ABSTRACT

A unique system and method for directly feeding sheets into a printing device having a moving image conducting element with a plurality of images placed thereon for transfer to sheet paper and having a wait station for controlling the timing of paper transfer to the image conducting element provides a feeding table to transfer sheets from a source to a printer stack deshingler while bypassing and, thus, eliminating any need for sheet stacks. The movement of each sheet by the wait station into the image transfer element signals the cutting of a sheet from a roll of continuous web on the input side of the feeding table. Once the sheet has moved into the image transfer element the absence of a sheet at the detector signals transfer by the feeding table of the cut sheet to the stack deshingler. Simultaneously, a source of web presents and end of the web representing another sheet to a cutting unit. This sheet is (out when the current sheet at the wait station begins movement into the image transfer element.

35 Claims, 3 Drawing Sheets

SYSTEM AND METHOD FOR DIRECTLY FEEDING PAPER TO PRINTING DEVICES

RELATED APPLICATIONS

This application is a continuation-in-part of U.S. patent application Ser. No. 07/536,214 filed Jun. 11, 1990 now U.S. Pat. No. 5,130,724.

FIELD OF THE INVENTION

This invention relates to a novel system and unique method for feeding a continuous stream of paper to a printing device without any need for stacking and deshingling individual sheets of paper.

BACKGROUND OF INVENTION

It is desirable to input materials such as paper to a printing operation in continuous form such as fan folded or roll form. The use of a roll, rather than sheets, allows longer intervals between reloading of the paper source. Roll fed paper, cut just prior to feeding, allows sheets to be various sizes without the need to change the size of the paper loaded in the stack. The use of a paper source roll also reduces packaging waste since stacked paper sheets must be stored in a large number of individual boxes. However, many printing devices are specifically designed to accept only stacked, pre-cut sheets of paper. The stack is fed by a deshingler that removes sheets from the stack and delivers them to the printing element. This deshingler operates slowly enough to accommodate the necessary timing of print operations. However, without the deshingler to regulate feeding, the printer cannot generally operate continuously unless some other method of regulating paper feed is provided.

Previous devices, produced by, for example, the Hunkler Company of Switzerland have dealt with the problem of providing a continuous roll source of paper to a printer, designed only for use with stacked paper sheets, by continuously cutting and adding additional sheets from the roll to this input paper stack feed unit. This method has been particularly adapted for the Xerox™ 87xx and 97xx series such as the 9700 Laser Printer, and for various duplicators. The problem with this method is that the printer must still deshingle and individually feed sheets of paper from the stack feed unit. The result is increased, rather than decreased overall complexity and a greater chance of system failure due to the need to now accurately cut and stack paper sheets from the roll as well as to subsequently unstack the sheets of paper to feed them to the printer.

Other prior art devices also particularly directed toward the Xerox™ 9700 have eliminated the need for shingling and deshingling of paper, thus allowing direct feeding, by modifying the operating software of the printer so that its timing of operation will match that of the feeding device. The problem with such an approach is that the feeding device has lessened versatility with respect to other machines while installation time and expense are increased due to the need to modify software in the printer.

SUMMARY OF THE INVENTION

It is therefore an object of this invention to provide a unique system and method for continuously feeding a printing device from a continuous roll of paper material.

It is another object of this invention to provide a system and method for feeding a printing device that requires no alteration to the operating software of the device.

It is another object of this invention to provide a system and method for feeding a printing device that allows sheets of various sizes and shapes to be accurately fed and printed upon.

It is another object of this invention to provide a system and method for feeding a printing device that requires no shingling or deshingling of the paper between the source and the printer's image conducting belt or drum.

It is another object of this invention to provide a system and method for feeding a printing device that may be attached and detached from the printing device quickly and forms part of a modular system that includes a plurality of different feeding devices.

It is yet another object of this invention to provide a system and method for feeding a printing device that is specifically applicable to the Xerox™ 9700 Laser Printer, but may also be adaptable to a variety of other printers.

This unique invention provides a system and method for directly feeding unstacked paper sheets into a printing device having movage image conducting element with a plurality of images for transfer to the paper placed thereon and also having a wait station for controlling the timing of paper transfer to the image conducting element. The system comprises a means for directing a continuous stream of paper sheets to a printing device wait station. There is a means for controlling the rate of movement of the paper sheets into the wait station to present each paper sheet at a programmed or otherwise predetermined time relative to the operating speed of an image conducting element of the printing device. Means are provided for regulating the spacing of a leading edge of each paper sheet as it is presented to the wait station. This spacing is relative to the spacing between consecutive images on the image conducting element.

In one embodiment, the printing device is a laser printer and the image conducting element is one of either a constant speed belt or drum, upon which, images are placed for transfer. This system may be particularly adapted to a Xerox™ 9700 series laser printer. There may be provided a means for controlling the rate of paper sheet feeding that includes a predetermined rate equal to approximately 20 inches per second and a means for regulating the spacing of fed paper sheets that includes a spacing equal to approximately 10 inches. The system may also comprise a means for cutting the paper sheets to predetermined sizes from the input of a continuous paper web. This continuous paper web may be input from a roll. There may be included in this system a means for driving the roll in synchronization with the means for directing the paper sheets so that each cut paper sheet proceeds without delay to the wait station. The means for regulating paper spacing may include a means for detecting the leading edge of each paper sheet.

In an alternative embodiment a system for directly feeding sheets to a printing device according to this invention provides a means for bypassing a printer stack feeding storage unit that includes a table for guiding sheets in a downstream direction into the stack deshingler. The stack deshingler itself is a unit that removes sheets one at a time and positions the sheets within a wait station means which, itself, feeds these sheets to an image transfer element upon demand of the image transfer element. The table includes a means for detecting movement of each sheet upon the table through the stack deshingler and into the image transfer element and/wait station. There is additionally provided on the table a means for sensing the absence of a sheet proximate the stack deshingler. The table further includes a means for driving sheets therealong from an upstream side to the stack deshingler in response to the absence of a sleet at the means for sensing. Sheets are provided at the upstream side of the table to the means for driving in response to at least one or both of the means for sensing absence of sheets and means for detecting movements of sheets. In particular, the sheets provided to the upstream side of the table may originate from a roll source of continuous web that is cut on demand in response to the detection of movement of sheets through the deshingler. Sheets are continuously driven into the cutter to lay partially upon the table in response to the sensing of the absence of sheets as they are fed to the image transfer element. The roll source, the cutter feeder, and particularly the table may include wheels to allow their motion to and from the printer. Each of these units is modular and may be operated without any specific electronic interconnection with the printer.

BRIEF DESCRIPTION OF THE DRAWINGS

The foregoing objects and advantages of the present invention will be more clearly understood in connection with the accompanying drawings in which.

DETAILED DESCRIPTION OF THE PREFERRED EMBODIMENTS

Figure 1:
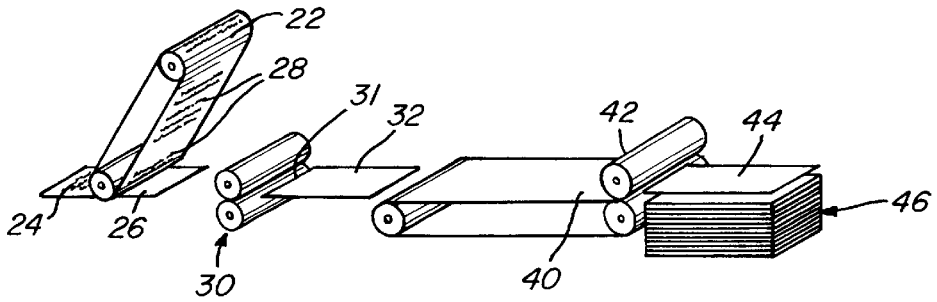
Fig. 1 (PRIOR ART)
FIG. 1 is a schematic illustration of a prior art method of feeding paper requiring deshingling of stacked sheets.

A photoreprographic printing system of the prior art is generally depicted in FIG. 1. This type of printing system is used, for example, in the Xerox™ 9700 Series Laser Printer. It generally consists of an image conductor element 22 comprising either a belt or drum upon which printing toner is placed in the form of the desired print images. The image conductor belt 22 shown herein contains several images 28 that are laid down at 24 upon a piece of paper 26 as it passes under the contacting surface of the belt. Each piece of paper is fed to the image element by means of a "wait station" 30. This wait station includes a pair of rollers that forcibly drive a sheet of paper into the image element at a given time corresponding to the motion of the image conductor belt. The wait station 30 is synchronized to drive the leading edge 31 of a sheet of paper 32 into the image conductor belt each time an image on the image conductor belt 22 is aligned to properly print upon the sheet of paper when it reaches the image conductor belt. The feeding of the wait station, as shown in FIG. 1, is accomplished in most printer systems by deshingling a stack of paper 46, one sheet at a time, and feeding each sheet 44 at a predetermined rate to the wait station 30, using a feed driving belt and pinching roller 40 and 42, respectively. As each sheet is fed to the wait station it is held for a small interval until the image element is again ready to receive a new piece. If the wait station does not receive a new piece of paper by the time the next image is ready to be printed, the system will shut down displaying a jam or paper refill signal.

Any feeding system that correctly interfaces with this type of printer must be able to directly feed the wait station of the printing element so that it receives a sheet of paper within the correct period of time to prevent the wait station from indicating an error. Also, it must not feed too quickly since this would cause a feeding backlog at the wait station.

Figure 2:
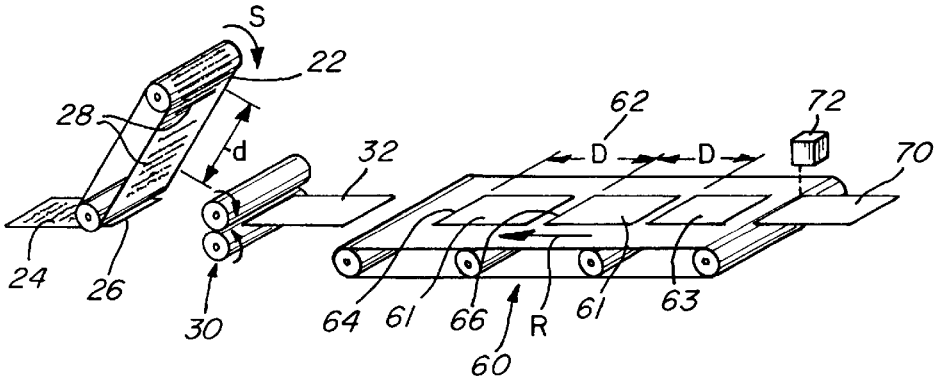
FIG. 2 is a schematic illustration of a direct feeding system according to this invention.

Reference is now made to a direct feeding system as depicted in FIG. 2 and as in accordance with the present invention. In this schematic drawing, paper sheets 70 are fed to a conveying or feeding system 60 that moves paper at a specific rate R to the wait station 30. Each sheet is delivered to the station 30 at a specific point of time in order to insure that it be fed to the image conducting belt 22 in synchronization with the print images laid down on the belt. In order to insure that this precise synchronization be obtained, the parameters of image conducting belt speed S and the distance between the leading edge of each new image d on the image conducting belt is determined. These parameters are directly relative to the feeding speed. In the example of a Xerox™ 9700 Laser Printer, the image belt speed is 20 inches per second and the distance between each image leading edge D is 10 inches. As such, the system 60 is designed to separate each leading edge of input paper sheets by a distance D 62 that equals the image conducting belt image distance d. In this case, the distance is 10 inches.

In FIG. 2 the leading edges 64 and 65 of each paper sheet 61 are separated by the distance D. This spacing may be accomplished by detecting at 72 the leading edge of a sheet each time a sheet is presented to a feeding mechanism or conveyor 60. Each sheet is motioned down the feeding mechanism 60 when the appropriate distance from the preceding leading edge has been attained. Furthermore, each sheet of paper driven at this distance D travels down the feeding mechanism at a fixed rate R. In this example, the rate R will equal 20 inches per second, or the rate of the image conducting belt. The advantage of such a leading edge detect system is that various sizes of paper may be aligned to print accurately since each sheet is fed accurately with timing of feed based solely upon its own leading edge. As shown in FIG. 2, the second sheet 61 and third sheet 63 are of different sizes while each sheet's leading edge is aligned at precisely the same distance from the preceding one. This novel system only allows the next sheet to begin motion when the preceding leading edge has traveled exactly a distance D from the next sheet's leading edge. Since printing may occur without regard to size, the printing of unfolded envelopes, among other applications, is possible in large unstacked volume.

Figure 3:
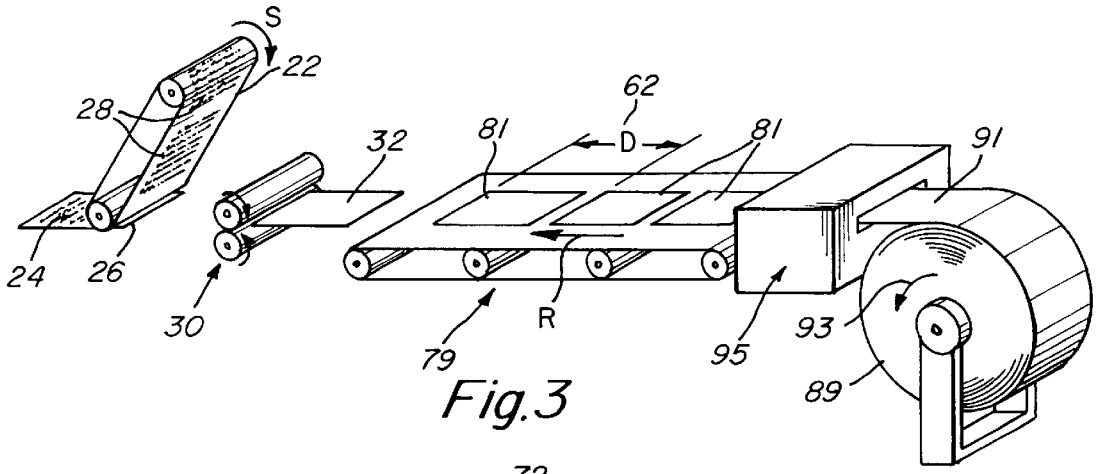
FIG. 3 is a schematic illustration of the direct feeding system of FIG. 2 including a paper feeding roll and sheet cutting device for increased production volume.

A significant feature of the direct feeding concept is the ability to input a continuous web of paper to the printing system. A roll 89 of paper web 91 is shown in FIG. 3. This paper web 91 is fed in a continuous manner into a cutting unit 95. The cutting unit 96 cuts sheets to a programmed or otherwise predetermined size sheet 81 that are then driven down the feeding device 79 with the required spacing D 62. The sheets are then delivered by the feeding mechanism or conveyor 79 to the wait station 30 and printed upon in the manner described herein above. The feed rate of the roll 93 to the cutting device 95 is synchronized to the general feed rate of the feeding mechanism 79. If so, each time a sheet is cut it may proceed on to the feeding device without delay.

In accordance with the invention, the station 30 may operate continuously assuming that the spacing D is proper as introduced to the station 30. Alternatively, the station 30 may operate somewhat intermittently with a slight wait possible for proper synchronization. Sheets can be provided early to the station 30 but cannot be provided late as this would cause a malfunction and shut-down.

As indicated previously, in accordance with the present invention, each sheet of paper, such as illustrated in FIG. 2, is carried by the feeding mechanism or conveyor 60 once the appropriate distance from the preceding leading edge has been attained. Assuming that the feeding mechanism 60 is set up for operation at a programmed or otherwise predetermined speed to match that of the image conducting belt 22, then one can employ a leading edge detector to determine the presence of a leading edge of a sheet being fed to the feeding device 60. Once this leading edge is detected, the input feed to the feeding mechanism 60 can be interrupted until the proper spacing occurs, namely the spacing D in FIG. 2 at which time the input feed proceeds so that all leading edges are spaced the proper programmed distance, namely distance D in FIG. 2.

By way of further example, there can be separate feeding mechanisms, including an origination feeding mechanism and a feeding mechanism such as the conveyor-like feeding mechanism 60 shown in FIG. 2. The leading edge detector would, in essence, be between these two feeding mechanisms and would in essence take input sheets fed in a serial course that might be unsynchronized positionally and essentially convert the sheets into a synchronized positional arrangement on the feeding mechanism 60. Again, this occurs by detecting leading edges on the input feed mechanism and then permitting the sheets to be fed to the feeding mechanism 60 but only once the proper spacing D has been achieved.

Figure 4:
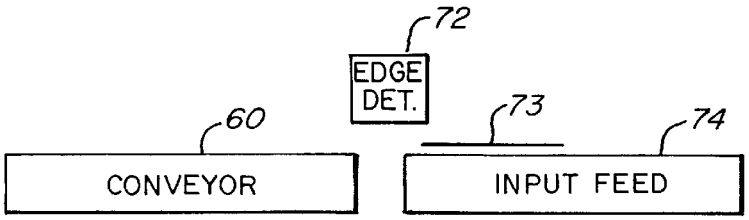
FIG. 4 schematically illustrates an edge detector used with the feed mechanism in accordance with the present invention.

Now, with regard to the synchronization of sheets onto the feeding mechanism or conveyor 60, refer to FIG. 4 which is a schematic diagram illustrating the conveyor 60 as well as an input feed 74, and edge detector 72, and a typical sheet 73. The sheet 73 is fed on the input feed. The edge detector 72 detects an edge of this sheet and essentially holds the sheet in readiness for the conveyor 60 moving to a particular position at which time the sheet 73 continues to be fed onto the conveyor 60 with the proper spacing between sheets as illustrated in FIG. 2 by the spacing D.

Figure 5:
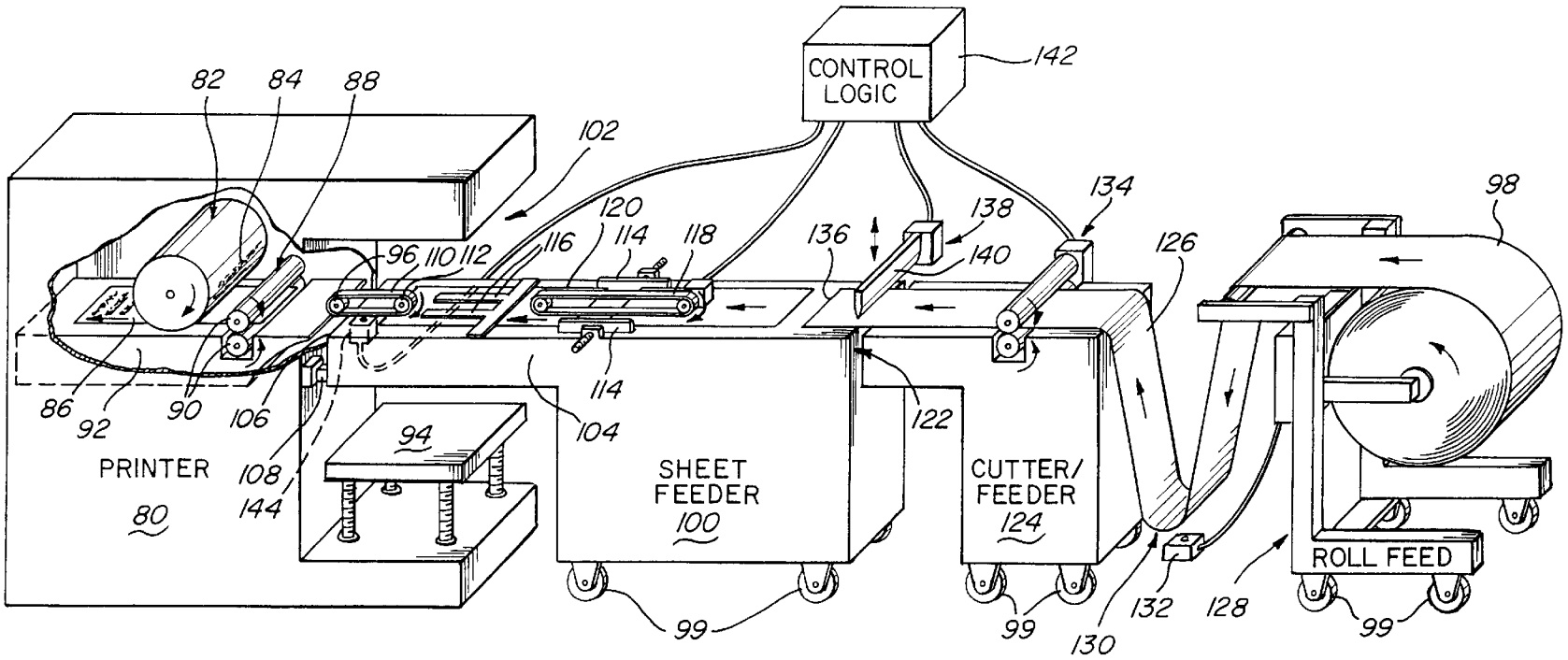
FIG. 5 is schematic illustration of another embodiment of a modular direct feeding system according to this invention.

An alternative embodiment of a sheet feeding system according to this invention is depicted somewhat schematically in FIG. 5. The system includes a printer 80 such as the Xerox™ 9700 Laser Printer having an image element 82 that revolves to place toner in the form of text 84 upon sheets 86 passed thereunder. As described above, the image element 82 rotates continuously and when the text 84 on the element 82 is circumferentially positioned in alignment with a leading edge of a sheet, the sheet is then advanced through the image element by means of the "wait station" 88. The wait station 88 in this example is a pair of pinch rollers 90 that hold the sheet 86 until the proper synchronization of image element text to sheet position is obtained. The sheet 86 is then advanced downstream by the wait station rollers 90 along a printer feeding table 92 so that it converges with the text-carrying portion of the image element at the proper time. In this way, text is accurately laid upon the appropriate section of the sheet. After a sheet passes from the wait station 88 through image element 82, the wait station 88 is then free to receive another sheet which it will hold until the image element again rotates to place the text in a proper position in which to begin driving the next sheet into convergence with the image element 82.

Normally, as depicted in FIG. 1, sheets are deshingled from a stack which, in this embodiment, is supported on an upwardly moving base 94 that is built into the printer 80. In this embodiment, the deshingler itself comprises elastomeric wheel 96 that projects over an edge of the printer feeding table. In a normal stack feeding operation, sheets would be driven upwardly by the base 94 to the level of the printer feeding table 92, as sheets were removed by the deshingler wheel 96, so that a top sheet in the stack would remain in contact with the deshingler wheel 96. The deshingler wheel 96 would be commanded to rotate to drive the sheet into the wait station 88 sometime soon after a prior sheet had moved downstream, clearing the wait station 88, and had been driven through the image element 82. Thus, the wait station 88 would always have a reserve deshingled sheet to present to the image element 82 at the appropriate time.

As stated previously, however, a printer that utilizes only stack feeding must be refilled quite frequently. It would be desirable, instead, to continuously and directly feed sheets to the wait station from a much larger source than an integral stack feeder. In this embodiment, a source derived from a roll 98 of continuous web is utilized. Such a source may contain many times the number of sheets as a typical printer storage stack.

A modular system is utilized for feeding sheets from the roll source 98 according to this embodiment. Each separate unit of the system may, thus, be attached to and detached from the printer 80 and each other without substantial alteration of the printer's working components or operating software. Rollers or wheels 99 are provided for portability. In particular, a modular sheet feeder 100 according to this invention, having wheels for portability, is mounted into the preexisting stack feed access port 102 of the printer 80. The sheet feeder 100 is constructed with a table 104 that aligns with and is level with the printer feeding table 92 and has a downstream edge 106 that stands directly below the deshingler wheel 96. Thus sheets may pass unimpeded from the sheet feeder's table 104 to the printer feeding table 92. The sheet feeder 100 may include guiding lugs 108 or similar locking elements that help to maintain the sheet feeder module 100 in alignment with the printer 80.

In this embodiment, the printer 80 has been modified to include an extended drive belt 110 and idler roller 112 that are rotatably connected to the deshingler wheel and that further overlap the table 104 of the feeder 100. Note that the feeder's table 104 is elevated in the region of the stack base 94 so that it effectively bypasses (bridges) the stack base 94 and enables the transfer of a horizontal stream of sheets one at a time directly to the deshingler assembly 96, 110, 112 and wait station 88 units from outside the normal bounds of the printer housing. The primary substantive alteration to the normal printer functioning in this embodiment is the extending of the deshingler wheel 96 which may be accomplished by a simple attachable and detachable component that includes the belt 110 and idler roller 112.

The sheet feeder 100 itself includes movable side edge guides 114 to maintain sheets in appropriate transverse alignment as they are fed. It further includes, in this embodiment, a pair of spring loaded strips 116 to lightly maintain the sheets flatly against the table 104.

Operation of the sheet feeder 100 is accomplished by means of a drive or conveyor belt 118 disposed somewhat pressurably, opposite the surface of the table 104 to contact and transfer sheets (120) on demand from a sheet feeder upstream or input side 122 to the deshingler. The belt 118 may be slightly angled relative to the feeding direction to force sheets accurately up against an edge guide 114. The accurate driving of the belt 118 to transfer sheets downstream may be accomplished using, for example, a stepper or servo motor or a ratchet clutch. This process will be described further below.

Sheets are formed at the upstream input edge 122 of the feeder 100 by means of a cutter feeder apparatus 124 that draws a continuous web 126 from the roll feed/unwind unit 128. The roll feed/unwind unit 128 itself provides web upon demand of the cutter/feeder by means of a constant size loop 130 of web. This loop 130 is maintained at a constant size by means of a loop detector 132 that signals driving of the roll feed unit 128 as it becomes smaller due to cutter/feeder 124 drawing of web 126. One such roll feed unit for providing web upon demand is Applicant's Roll Support and Feed Apparatus, U.S. Pat. No. 4,893,763.

Continuous web 126 is drawn from the roll feed unit loop 130 specifically by means of a pair of driving rollers 134 or similar conveyors (such as pin feed conveyors) that bias the leading edge 136 of the web 126 downstream through a cutter 138. The precise distance of biasing depends upon the size of sheet selected. In general, the cutter/feeder 124 meters out a length of web equal to the programmed sheet length. The trailing (upstream) edge of this metered length finds itself under the blade 140 of the cutter 138 while the leading edge 136 is disposed upon the table 104 the sheet feeder 100.

The modular and independent functioning of the system, separate from any direct control by the printer, is based upon the controlling of each of the sheet feeder 100 and cutter/feeder 124 independently of the printer 80 using a separate control logic circuit 142 that interconnects each of the systems operating elements. Control is based primarily upon at least one table 104 mounted detector 144 that senses the state of a sheet relative to the image element 82 and wait station 88 in order to instruct the system. note that the sensing occurs without directly tapping into printer operating functions. The functioning of the system based upon the control logic circuit 142 is described further in FIGS. 6–9.

The operation of the system according to FIGS. 6–9 is depicted at various states. These figures illustrate the process in an on-going manner in which the initialization of feeding has already occurred. Arrows show the operation of various elements and the timing of such operation.

Figure 6:
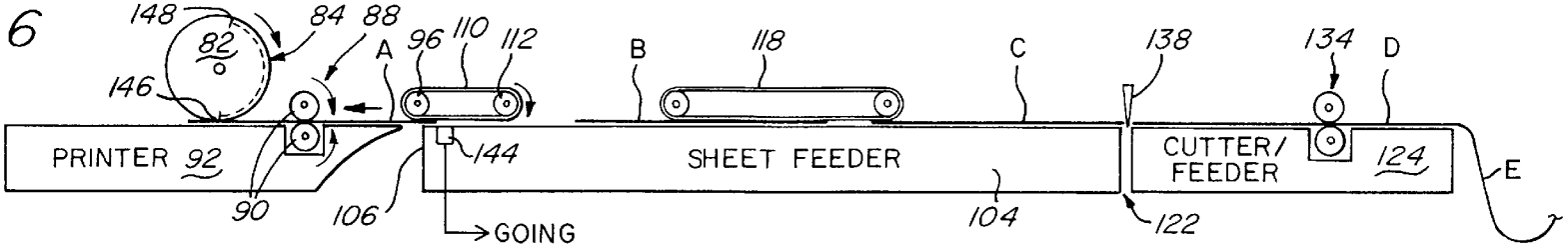
FIGS. 6–9 show schematically the movement of sheets during different operating states of the modular feeding system of FIG. 5.

FIG. 6 shows a sheet A being driven in a downstream direction by the rollers 90 of the wait station 88 into contact with the image element 82. The image element 82 contains text 84 along its circumference between two points 146, 148. In this embodiment, the image element 82 moves at a constant rate throughout the feeding process without stopping as long as it is instructed to continue printing. The trailing (upstream) edge of the sheet A passes under the deshingler roller and the attached belt and idler roller. Note that the deshingler roller usually includes a one-way clutch so that when the wait station rollers begin their rapid driving of the sheet, no resistive drag is imparted by the generally slower moving deshingler roller.

A second sheet E is positioned upstream of sheet A in a stationary position at the sheet feeder drive belt 118. This sheet is awaiting complete feeding of sheet A into the image element 82. A sheet C is also positioned on the sheet feeder table 104 near the input side 122 thereof. This sheet (C) is stationary, resting partially within the cutter/feeder 124 and partially within the sheet feeder. It is in the process of being cut from a continuous web D and E which extends upstream of the cutter/feeder 124. The rest of the input web D and E is likewise, stationary while the sheet A is being transferred into the image element 82 by the wait station 88.

A detector 144, which in this example is positioned proximate the downstream end 106 of the sheet feeder table 104 detects movement of sheet A into the image element 82. As a result of the presence of a moving sheet, the detector signals a "GOING" condition to the control logic 142 of FIG. 5. The control logic 142, thus, signals the cutter 138 to immediately separate input sheet C from the remainder of the continuous web D and E. Sheet C is, thus, fully separated from the web and ready to be pulled by the upstream end of the drive belt 118 at the appropriate time.

Figure 7:
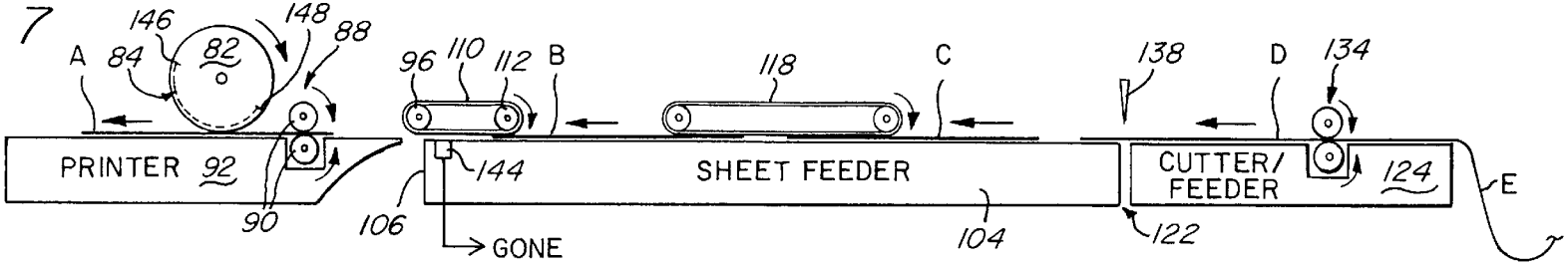

The subsequent movement of each of the upstream disposed sheets following the transfer of sheet A is accomplished as shown in FIG. 7. Once sheet A has cleared the sheet feeder table 104 and has passed substantially through the image element 82 and wait station 88, the detector 144 of this embodiment senses the absence of a sheet. This absence is translated into a "GONE" signal to the control logic 142. The control logic 142, in response to a "GONE", signals the cutter/feeder 124 and the sheet feeder drive belt 118 to translate over a distance sufficient to transfer sheet B into the deshingler belt assembly 96, 110, 112 and simultaneously transfer sheet C to the position formally occupied by sheet B, just upstream of the deshingler assembly. Similarly, the rollers 134 of the cutter/feeder 124 feed the leading (downstream) edge of the continuous web D and E onto the sheet feeder.

Figure 8:
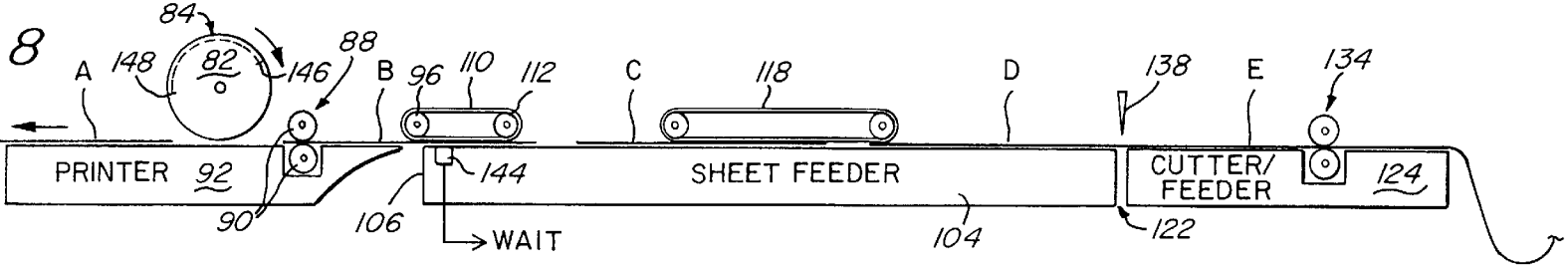

The completed repositioning (shown in progress in FIG. 7) of sheets is depicted in FIG. 8. Sheet B is now positioned within the wait station rollers 90 with its leading edge slightly (approximately one inch thereof) protruding downstream while sheet C stands in the belt 118, ready to be fed to the deshingler assembly 96, 110, 112 and sheet D now stands with its downstream leading edge partially under the feeder drive belt and its uncut upstream trailing edge located proximate the cutter. At this time, sheet D is still part of the continuous web E within the cutter/feeder. Note that while all other elements are stationary, the image element continues to rotate with the circumferential text image 84 not yet in synchronization with the next sheet B. The printer will again signal driving of the wait station rollers 90 only when the image 84 has rotated to the proper position to effect synchronized convergence of a driven sheet B with the image 84. Since sheet A has been completed, it is shown exiting the printer feeding table 92.

In the system state depicted in FIG. 8, each module of the system of this invention remains stationary awaiting proper alignment of the image element 82. Until such time, the wait station rollers 90 hold sheet B in a stationary unfed position. Note that the wait station rollers 90 are dependent for their movement directly upon the positioning of the image element 82 and are an integral part of the printer mechanism. Thus, since sheet B's movement is now dependent upon the wait station movement, the sheet in this state is stationary. As such, the detector 144 senses the presence of a non-moving sheet therein. The detector, consequently, signals a neutral or "WAIT" state in which the logic control 142 (FIG. 5) directs each of the sheet feeder belt 118 and cutter/feeder unit 124 to neither advance nor cut sheets.

Figure 9:
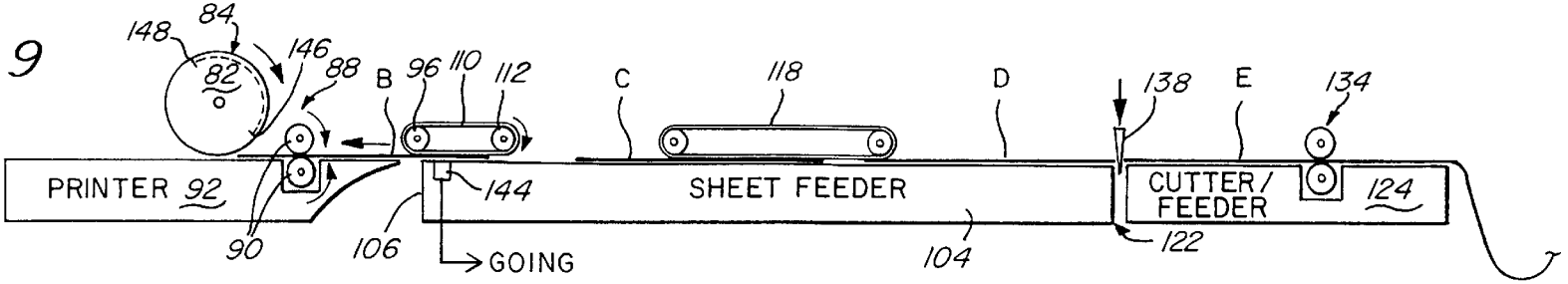

Once the image element 82 becomes positioned at the proper alignment point for printing text, the printer then signals the wait station rollers 90 to begin driving sheet B as depicted in FIG. 9. As such, the detector 144 now again signals a "GOING" state to the control logic 142 which instructs the cutter 138 to cut sheet D from the previously positioned downstream end of the continuous web E. Again, once sheet B clears the detector 144, a "GONE" state is signaled which causes the logic 142 to instruct the system to feed sheets C, D and E downstream. This cycle continues until the printer image element 82 is instructed to cease printing operation. At this time a final fed sheet may remain at the ready in the wait station 88 until the next print instruction causes the image element 82 to restart.

The elements of the cutter/feeder 124 and driving belt 118, in general, operate fast enough to insure that sheets are delivered to the deshingler as fast or faster than they are required. Otherwise, the printer may signal a jam or out of paper condition and cease operation.

Note that while one sheet feeder drive belt is shown according to this embodiment, two or more drive elements acting in concert may be utilized according to this unique invention. Similarly, the sheet feeder may carry two or more sheets along its table at any one time between the cutter 138 and the deshingler assembly 96, 110, 112. Each movement of a sheet into the image element would cause the advance of each of the plurality of sheets upon the table downstream by one, with a constant number of sheets always remaining on the table at any one time. Similarly, more than one detector may be utilized. The detectors may be positioned spaced from each other along the sheet feeder table. Each of the detectors would detect the presence or absence of a sheet, with the more upstream signaling a going state in the absence of a sheet and the more downstream signaling a gone state in the absence of a sheet. Detectors could function based upon infrared, ultrasonic or electromechanical mechanisms according to this invention. The system of this embodiment, in general, should detect the current operating state of the image element and wait station by means of its drawing of sheets and determine the position of each of the sheets fed thereinto in order to properly form and advance upstream sheets to the printer at the proper time.

It should be understood that the preceding is merely a detailed description of preferred embodiments. It will be obvious to those skilled in the art that various modifications can be made without departing from the spirit or scope of the invention. The preceding description is meant to be taken only by way of example and to describe only preferred embodiments and not to limit the scope of the invention.

What is claimed is:

1. An apparatus for feeding sheets to an input port of a utilization device, the input port adapted to be fed from a first source of sheets along a first feed path, the apparatus comprising:

a second source of sheets;

a support structure defining a second feed path for guiding sheets from the second source of sheets toward the input port, the support structure having an upstream end and a downstream end;

a drive mechanism that selectively moves sheets on the support structure along the second feed path from the upstream and to the downstream end of the support structure and toward the input port;

a sensor system that signals a position change of a sheet at the downstream end relative to the input port; and a controller that controls the drive mechanism to maintain an upstream position sheet in a substantially stationary position in response to a signal of the sensor system indicating movement of a downstream position sheet to the input port and to drive the upstream position sheet to a predetermined waiting position in readiness for introduction to the input port in response to a signal of the sensor system indicating that the downstream position sheet has reached a more downstream position within the input port.

2. An apparatus for feeding sheets to an input port of a printer or other utilization device, the sheets being fed along a single predetermined feed path, the apparatus comprising:

a source of cut sheets;

a support structure for the cut sheets having an upstream end and a downstream end and defining the single predetermined feed path;

the source of cut sheets disposed at the upstream end of the support structure;

means for selectively driving sheets on the support structure along the predetermined feed path from the upstream end and to the downstream end of the support structure and toward the input port;

control means for controlling the means for selectively driving sheets to maintain an upstream position sheet in a stationary position in response to a downstream position sheet being moved to the input port and to drive the upstream position sheet to a waiting position in readiness for introduction to the input port in response to the downstream position sheet reaching a more downstream position within the input port; and wherein the input port includes a sheet deshingler comprising a moving belt that overlies the downstream end of the support structure and operates to transfer sheets into the input port free of control by the control means.

3. An apparatus for feeding sheets to an input port of a printer or other utilization device, the sheets being fed along a single feed path, the apparatus comprising;

a source of sheets;

a support structure for the sheets having upstream and downstream ends, the support structure defining the single feed path that is disposed from the source to the input port and the support structure being constructed and arranged to bypass a sheet stack normally deshingled so that sheets therefrom are fed to the input port, the source being remote from the sheet stack;

the source of sheets disposed at the upstream end of the support structure;

a conveyor for selectively driving sheets on the support structure along the predetermined path from the upstream end and to the downstream end of the support structure and toward the input port;

means for supporting the support structure and conveyor in a fixed position relative to and in juxtaposition to the input port to enable the sheets to be fed directly along the single predetermined feed path; and control means for controlling the means for selectively driving sheets including first means responsive to a downstream position sheet being moved to the input port for maintaining an upstream position sheet stationary while the downstream position sheet is moving and second means responsive to the downstream position sheet reaching a more downstream position for driving the upstream position sheet to a predetermined waiting position in readiness for introduction to the input port.

4. A method for feeding sheets to an input port of a printer using a supporting surface on which the sheets are directed by a feed controller from an upstream end and to a downstream end of the supporting surface so that each of the sheets is positioned at the input port to be sequentially drawn into the printer upon demand by a printer control circuit and wherein the feed controller operates independent of and free of control by the printer control circuit, the method comprising the steps of:

drawing a first sheet from a waiting position at the downstream end of a support structure into the input port upon demand by the printer control circuit in synchronization with an image element that moves at a predetermined rate during a printing sequence so that the image element having an image along a portion thereof prints the image upon a desired portion of the first sheet;

providing a second sheet at the upstream end of the support structure upon demand by the feed controller in response to sensing draw of the first sheet from the waiting position into the input port; and driving the second sheet downstream to the waiting position upon demand by the feed controller in an asynchronous timing relative to movement of the image element, the step of driving being in response to sensing a draw of the first sheet from the waiting position so that the second sheet is present at the waiting position to await draw into the input port upon demand by the printer control circuit.

5. A feeding module for use with a utilization device having an input port for receiving sheets, comprising:

a supporting surface having an upstream end and a downstream end, the supporting surface constructed and arranged to releasably engage the input port and defining a feed path therealong that directs each of the sheets from the upstream end to the input port and a base including wheels so that the feeding module is portable relative to the utilization device;

a source of sheets at the upstream end;

a driving mechanism that drives each of the sheets along the supporting surface from the upstream end to the downstream end;

a sensor located at the downstream end that senses a positioning of a sheet relative to the downstream end; and a controller that instructs the driving mechanism to move sheets along the supporting surface to the downstream end adjacent the input port in response to an absence of sheets sensed by the sensor including an absence of sheets resulting from movement of sheets into the input port.

6. An apparatus for feeding sheets to an input port of a printer or other utilization device, the sheets being fed along a single predetermined feed path, the apparatus comprising:

a source of cut sheets, wherein the source of cut sheets includes means for feeding a continuous web and an upstream cutter for forming the cut sheets from the web;

a support structure for the cut sheets having an upstream end and a downstream end and defining the single predetermined feed path;

the source of sheets disposed at the upstream end of the support structure;

a drive mechanism that selectively moves sheets on the support structure along the predetermined feed path from the upstream end and to the downstream end of the support structure toward the input port;

a sensor system that signals a position change of a sheet at the downstream end relative to the input port; and a controller that controls the drive mechanism to maintain an upstream position sheet in a substantially stationary position in response to a signal of the sensor system indicating movement of a downstream position sheet to the input port and to drive the upstream position sheet to a predetermined waiting position in readiness for introduction to the input port in response to a signal of the sensor system indicating that the downstream position sheet has reached a more downstream position within the input port.

7. An apparatus as set forth in claim 6, wherein the controller controls the cutter to operate so as to form a cut sheet while the roll is stationary and in response to a signal of the sensor system that the downstream position sheet is moving into the input port.

8. The apparatus as set forth in claim 6 wherein the support structure comprises a portable module constructed and arranged to be detachably engaged to the input port, and wherein the input port is constructed and arranged to receive sheets from a stack of cut sheets, the support structure being positioned in a location normally occupied by a top sheet of the stack.

9. The apparatus as set forth in claim 8 wherein the sensor system includes a sheet presence sensor at the downstream end of the support structure and wherein the controller and the input port are free of electronic communication therebetween and wherein the controller controls operations based only upon a sensing state of the sheet presence sensor.

10. The apparatus as set forth in claim 9 further comprising adjustable guides located on the support structure for guiding widthwise edges of sheets passing therealong, the guides being adjustable in a direction substantially transverse to the upstream-to-downstream direction.

11. An apparatus as set forth in claim 6, wherein the continuous web is provided from a continuous roll that is supported by a roll support.

12. An apparatus for feeding sheets to an input port of a printer or other utilization device, the sheets being fed along a single predetermined feed path, the apparatus comprising:

a source of cut sheets;

a support structure for the cut sheets having an upstream end and a downstream end and defining the single predetermined feed path;

the source of cut sheets disposed at the upstream end of the support structure, wherein the source of cut sheets includes a continuous web having a downstream end located adjacent the upstream end of the support structure and a cutter located adjacent the upstream end of the support structure, the cutter separating each of the sheets from the downstream end of the continuous web to define each upstream position sheet;

a drive mechanism that selectively moves sheets on the support structure along the predetermined feed path from the upstream end and to the downstream end of the support structure and toward the input port;

a sensor system that signals a position change of a sheet at the downstream end relative to the input port; and a controller that controls the drive mechanism to maintain an upstream position sheet in a substantially stationary position in response to a signal of the sensor system indicating movement of a downstream position sheet to the input port and to drive the upstream position sheet to a predetermined waiting position in readiness for introduction to the input port in response to a signal of the sensor system indicating that the downstream position sheet has reached a more downstream position within the input port.

13. The apparatus as set forth in claim 12 wherein the controller is constructed and arranged to operate the cutter following a driving of the downstream end of the continuous web onto the upstream end of the support structure so that a cut sheet is formed at the upstream end of the support structure, the controller operating the cutter in response to the driving of the downstream position sheet into the input port.

14. The apparatus as set forth in claim 13 wherein the support structure is constructed and arranged to support at least three sheets thereon, the controller operating the drive mechanism to transfer a sheet at the upstream end of the support structure, adjacent the cutter, to an intermediate location on the support structure between the upstream end and the downstream end thereof, and a sheet at the intermediate location of the support structure being substantially simultaneously transferred by the drive mechanism downstream into the input port, the transfer of each of the sheets being in response to the absence of a sheet adjacent the downstream end of the support structure.

15. An apparatus for feeding sheets to an input port of a printer that utilizes a moving image element to transfer images onto sheets, the apparatus comprising;

a source of sheets;

a support structure for the sheets having an upstream end adjacent the source of sheets and a downstream end adjacent the input port, the support structure defining a single predetermined feed path;

a drive mechanism constructed and arranged for driving the sheets on the support structure along the predetermined feed path from the upstream end and to the downstream end such that each of the sheets is positioned to be drawn into the printer input port at a first time in synchronization with movement of the image element of the printer upon demand by the printer wherein an image is printed at a selected location on selected of the sheets;

a sensor system that signals a position change of a sheet at the downstream end relative to the input port; and a controller that controls the drive mechanism to drive each of the sheets along the support structure in a downstream direction at a second time, that is asynchronous with and between each first time, the drive mechanism driving each of the sheets in response to a signal of the sensor system indicating a sensing of a relocation of each of the sheets from the downstream end into the input port so that each of the sheets is positioned in readiness to be drawn into the input port upon demand by the printer at each first time.

16. The apparatus as set forth in claim 15, wherein the upstream end is constructed and arranged to receive sheets from the source of sheets based upon movement of each of the sheets into the input port.

17. The apparatus as set forth in claim 15, further comprising a cutter and a source of continuous web, wherein the cutter cuts each of the sheets from the source of continuous web in response to the movement of each of the sheets into the input port.

18. The apparatus as set forth in claim 15, wherein the support structure includes a base having wheels and wherein the downstream end is constructed and arranged to detachably engage the input port so that the support structure is portable.

19. The apparatus as set forth in claim 15 further comprising a first sensor, interconnected with the controller, located at the downstream end that senses at least one of movement, presence and absence of sheets at the downstream end.

20. The apparatus as set forth in claim 19, wherein the first sensor comprises an optical sensor.

21. The apparatus as set forth in claim 19 wherein the controller is constructed and arranged to instruct the drive mechanism to drive each of the sheets to the downstream end in response to a sensing of an absence of sheets by the first sensor at the downstream end.

22. The apparatus as set forth in claim 19 further comprising a second sensor, interconnected with the controller, located upstream of the first sensor and constructed and arranged so that movement of sheets into the input port out of engagement with the second sensor and still engagement with the first sensor signals movement of a sheet to the controller and wherein movement of each of the sheets out of engagement with the first sensor and the second sensor signals absence of the sheet at the downstream end.

23. The apparatus as set forth in claim 22, wherein the upstream end is constructed and arranged to receive sheets from the source of sheets based upon movement of each of the sheets into the input port.

24. The apparatus as set forth in claim 23, further comprising a cutter and a source of continuous web, wherein the cutter cuts each of the sheets from the source of continuous web in response to the movement of each of the sheets into the input port.

25. A method for feeding sheets to an input port of a printer using a supporting structure that communicates with the input port and on which the sheets are directed from an upstream end and to a downstream end of the supporting structure to await drawing thereof into the input port, comprising the steps of:

drawing each of the sheets from the downstream end of the supporting structure into the input port at a first time in synchronization with movement of an image element of the printer to thereby print an image on selected of the sheets;

providing sheets to the upstream end of the supporting structure; and driving each of the sheets, asynchronously relative to the step of drawing, in a downstream direction to the downstream end of the supporting structure at a second time between each first time to await the step of drawing at each first time, the step of driving including sensing a drawing of each of the sheets from the downstream end into the input port to thereby instruct driving of each of the sheets to the downstream end of the supporting structure adjacent the input port at each second time.

26. The method as set forth in claim 25, further comprising providing the sheets to the upstream end of the supporting structure in response to sensing movement of each of the sheets from the downstream end of the supporting structure into the input port by the step of sensing.

27. The method as set forth in claim 26, wherein the step of providing includes cutting the sheets from a source of continuous web.

28. The method as set forth in claim 25, wherein the step of driving includes driving of each of the sheets to the downstream end of the supporting structure at each second time in response to sensing of the absence of sheets at the downstream end by the step of sensing.

29. The method as set forth in claim 25, further comprising locating each of the sheets at an intermediate position on the supporting structure between the upstream end and the downstream end at each second time for transfer to the downstream end at a subsequent second time.

30. The method as set forth in claim 25, further comprising providing a means for removably attaching the supporting structure relative to the input port and moving the supporting structure away from and out of communication with the input port.

31. A method for feeding sheets to an input port of a utilization device, comprising the steps of:

removably locating a downstream end of a supporting structure adjacent the input port, the input port being a port normally adapted to receive sheets from a stack of sheets thereat, the step of removably locating including bypassing the stack of sheets and being located at a position normally occupied by a top sheet of the stack of sheets;

providing sheets to an upstream end of the supporting structure;

selectively directing sheets to the downstream end of the supporting structure at a first time;

drawing sheets from the downstream end of the supporting structure into the input port at a second time;

sensing movement of sheets from the downstream end to the input port and instructing, in response to the movement, the step of providing to provide a sheet to the upstream end of the supporting structure; and sensing absence of a sheet, subsequent to the sensing of movement, at the downstream end and instructing the step of directing to direct a sheet to the downstream end of the supporting structure adjacent the input port.

32. A method as set forth in claim 31, wherein the step of providing includes the step of cutting a sheet from an end of a source of continuous web at the upstream end of the supporting structure and the step of feeding an end of the source of continuous web onto the upstream end.

33. A method as set forth in claim 32, wherein the step of cutting occurs in response to the step of sensing movement of a sheet to the input port.

34. A method as set forth in claim 32, wherein the step of feeding occurs in response to the step of instructing the step of directing to direct a sheet to the downstream end.

35. A method as set forth in claim 32, wherein the step of feeding includes the step of transferring a source of continuous web from a roll of continuous web.

* * * * *